US011031684B2

(12) United States Patent
Yamada et al.

(10) Patent No.: US 11,031,684 B2
(45) Date of Patent: Jun. 8, 2021

(54) EARTH-MOVING MACHINE

(71) Applicant: KOMATSU LTD., Tokyo (JP)

(72) Inventors: Takeo Yamada, Tokyo (JP); Hiroshi Abe, Tokyo (JP); Ryosuke Okui, Tokyo (JP); Gousuke Nakashima, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 15/757,677

(22) PCT Filed: Jun. 26, 2017

(86) PCT No.: PCT/JP2017/023373
§ 371 (c)(1),
(2) Date: Mar. 6, 2018

(87) PCT Pub. No.: WO2019/003266
PCT Pub. Date: Jan. 3, 2019

(65) Prior Publication Data

US 2019/0027820 A1 Jan. 24, 2019

(51) Int. Cl.

| | |
|---|---|
| ***E02F 9/26*** | (2006.01) |
| ***H01Q 1/32*** | (2006.01) |
| ***E02F 9/08*** | (2006.01) |
| ***H01Q 1/12*** | (2006.01) |
| ***H01Q 21/28*** | (2006.01) |
| *E02F 3/32* | (2006.01) |

(52) U.S. Cl.
CPC ..... *H01Q 1/3291* (2013.01); *E02F 9/0891* (2013.01); *E02F 9/26* (2013.01); *H01Q 1/1207* (2013.01); *H01Q 1/3233* (2013.01); *H01Q 1/3275* (2013.01); *H01Q 21/28* (2013.01); *E02F 3/325* (2013.01)

(58) Field of Classification Search
CPC ..... E02F 9/0858; H01Q 1/325; H01Q 1/3233; H01Q 1/3291; H01Q 1/32; G01S 19/03; G01S 19/41
USPC ..... 701/32.4, 215, 412, 470, 471
See application file for complete search history.

(56) References Cited

U.S. PATENT DOCUMENTS

| | | | | |
|---|---|---|---|---|
| 4,788,550 A * | 11/1988 | Chadima, Jr. | B60R 13/005 | 280/762 |
| 5,925,085 A * | 7/1999 | Kleimenhagen | E01C 19/004 | 37/348 |
| 5,935,183 A * | 8/1999 | Sahm | E01C 19/006 | 172/4.5 |
| 6,266,582 B1 * | 7/2001 | Bruckner | G01C 21/165 | 342/357.31 |

(Continued)

FOREIGN PATENT DOCUMENTS

| | | |
|---|---|---|
| JP | H11-81380 A | 3/1999 |
| JP | 2005-267568 A | 9/2005 |

(Continued)

*Primary Examiner* — Ronald P Jarrett
(74) *Attorney, Agent, or Firm* — Faegre Drinker Biddle & Reath LLP

(57) ABSTRACT

A hydraulic excavator includes: a vehicular body; a cab placed on the vehicular body; and a plurality of antennas for receiving satellite positioning signals, the plurality of antennas including a main antenna and a sub-antenna. The main antenna is attached to the cab. The sub-antenna is attached to the vehicular body without the cab being interposed.

13 Claims, 7 Drawing Sheets

(56) References Cited

U.S. PATENT DOCUMENTS

| | | | | |
|---|---|---|---|---|
| 6,377,881 | B1 * | 4/2002 | Mullins | A01B 69/008 172/2 |
| 6,681,180 | B2 * | 1/2004 | Bevly | B60T 8/172 280/5.5 |
| 7,317,977 | B2 * | 1/2008 | Matrosov | E02F 3/842 701/470 |
| 7,925,439 | B2 * | 4/2011 | McCain | E02F 3/435 701/468 |
| 8,594,879 | B2 * | 11/2013 | Roberge | A01B 69/007 701/23 |
| 2004/0263403 | A1 * | 12/2004 | Zafar | H01Q 1/1271 343/713 |
| 2006/0108309 | A1 * | 5/2006 | Sato | E02F 3/325 212/232 |
| 2009/0222204 | A1 * | 9/2009 | Roberts | G05D 1/0259 701/470 |
| 2010/0246694 | A1 * | 9/2010 | Tsutsui | H01Q 1/325 375/257 |
| 2014/0022129 | A1 * | 1/2014 | Yoon | H01Q 1/1214 343/713 |
| 2014/0133945 | A1 | 5/2014 | Nishimura | |
| 2014/0133946 | A1 | 5/2014 | Nishimura | |
| 2014/0133947 | A1 | 5/2014 | Nishimura | |
| 2014/0133949 | A1 * | 5/2014 | Nishimura | E02F 9/0833 414/744.2 |

FOREIGN PATENT DOCUMENTS

| | | | |
|---|---|---|---|
| JP | 1278235 | * | 8/2006 |
| JP | 2007-69799 | A | 3/2007 |
| JP | 2008-38438 | A | 2/2008 |
| JP | 5296945 | B | 9/2013 |
| JP | 2014-512772 | A | 5/2014 |
| JP | 2015-021320 | A | 2/2015 |
| KR | 10-2014-0023909 | A | 2/2014 |
| KR | 10-2015-0021946 | A | 3/2015 |
| WO | WO-2014/076760 | A1 | 5/2014 |
| WO | WO-2014/076761 | A1 | 5/2014 |
| WO | WO-2014/076763 | A1 | 5/2014 |
| WO | WO-2014/076764 | A1 | 5/2014 |

* cited by examiner

EARTH-MOVING MACHINE

TECHNICAL FIELD

The present invention relates to an earth-moving machine.

BACKGROUND ART

An earth-moving machine including an antenna for GNSS (Global Navigation Satellite System) has been conventionally known. In an earth-moving machine disclosed in Japanese Patent Laying-Open No. 2015-21320 (PTD 1), antennas are disposed on an upper surface of a device chamber on the rear side of a cab and on an upper surface of a hydraulic oil tank.

CITATION LIST

Patent Document

PTD 1: Japanese Patent Laying-Open No. 2015-21320

SUMMARY OF INVENTION

Technical Problem

When an earth-moving machine includes a plurality of antennas for receiving satellite positioning signals, it is required to arrange the antennas at the largest possible distance from one another in a lateral direction in order to improve the accuracy of positioning.

In the case of a small-sized earth-moving machine, an area of a vehicular body frame is small. In the case of a short tail swing hydraulic excavator, a vehicular body frame on the rear side of a vehicular body is formed in an arc shape centered at a swing center when viewed from above, and thus, an area of the vehicular body frame on the rear side of the vehicular body is particularly small. Therefore, it is difficult to arrange a plurality of antennas at positions separate from one another.

An object of the present invention is to provide an earth-moving machine in which a plurality of antennas for receiving satellite positioning signals can be appropriately arranged.

Solution to Problem

An earth-moving machine according to the present invention includes: a vehicular body; a cab placed on the vehicular body; and a plurality of antennas for receiving satellite positioning signals, the plurality of antennas including a first antenna and a second antenna. The first antenna is attached to the cab. The second antenna is attached to the vehicular body without the cab being interposed.

Advantageous Effects of Invention

According to the present invention, the plurality of antennas for receiving satellite positioning signals can be appropriately arranged.

DESCRIPTION OF EMBODIMENTS

Figure 1:
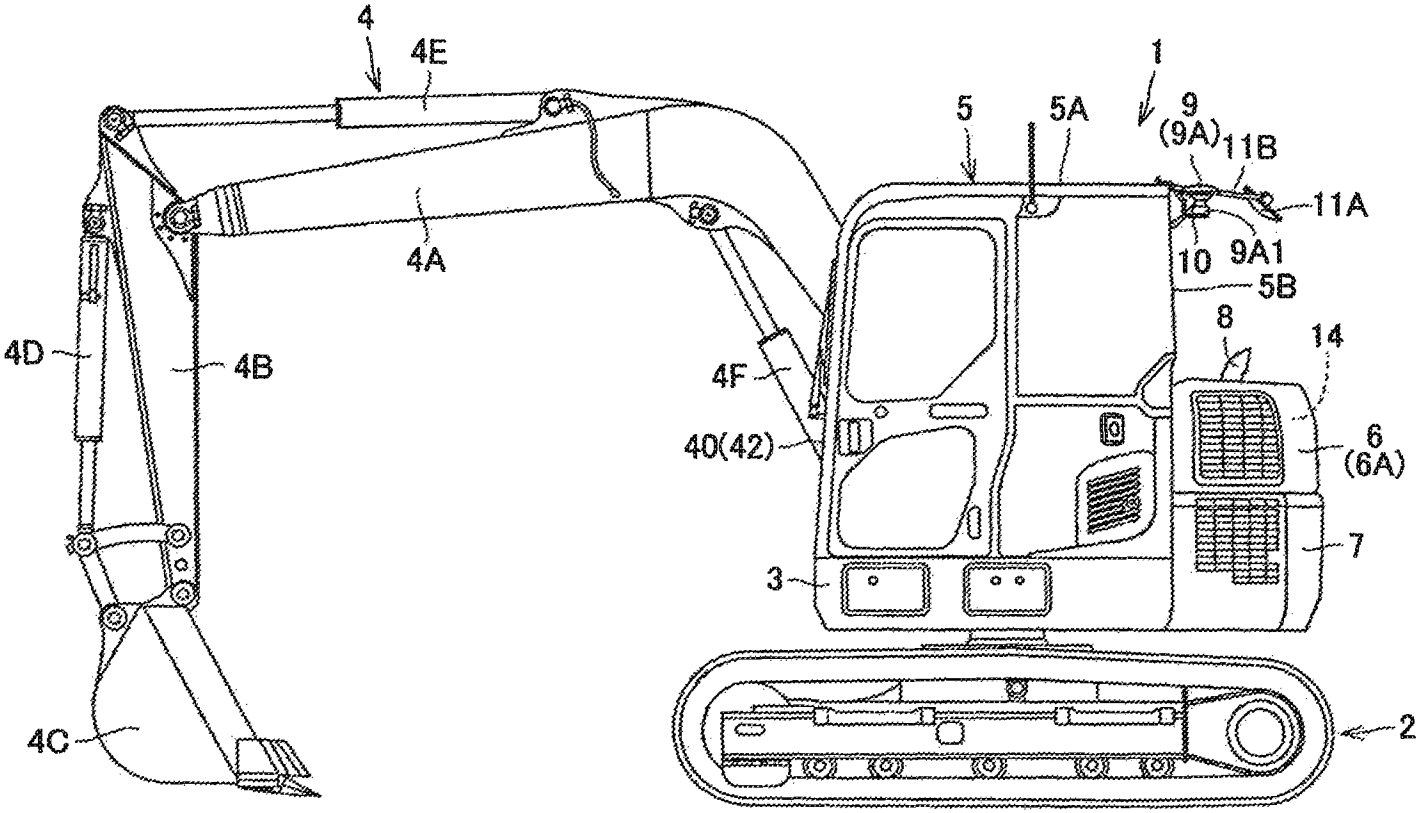
FIG. 1 is a side view schematically showing a construction of a hydraulic excavator based on an embodiment.

An embodiment will be described hereinafter with reference to the drawings. In the following description, the same components are designated by the same reference characters. Names and functions thereof are also the same. Therefore, the detailed description of them will not be repeated.

Although a short tail swing hydraulic excavator 1 will be described as one example of an earth-moving machine in the embodiment, the idea of the embodiment is also applicable to other types of earth-moving machines.

Figure 2:
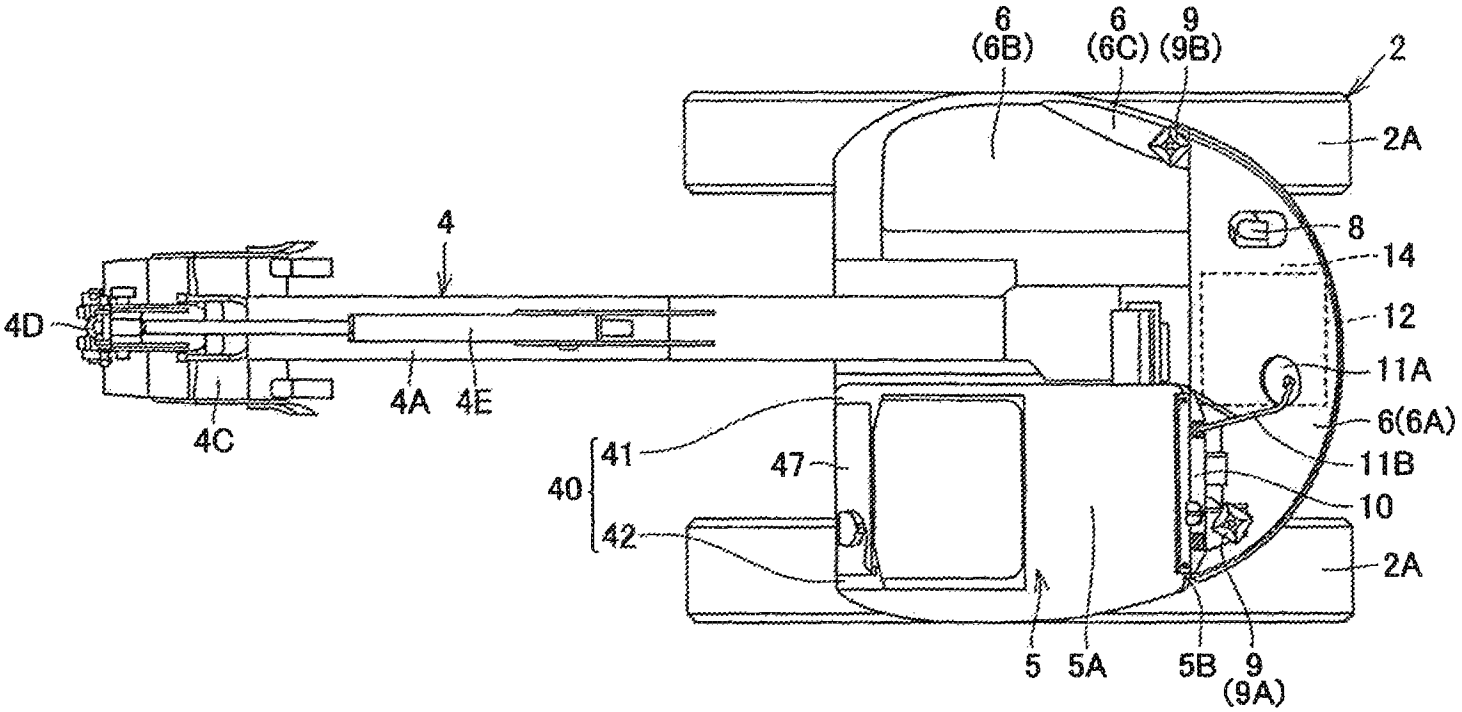
FIG. 2 is a plan view of the hydraulic excavator shown in FIG. 1.
Figure 3:
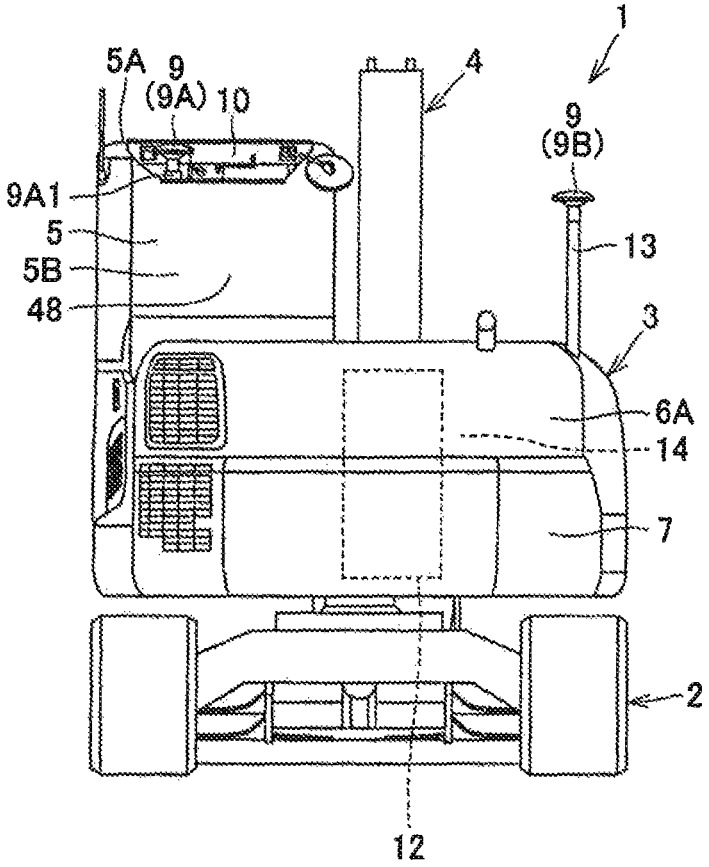
FIG. 3 is a rear view of the hydraulic excavator shown in FIG. 1.
Figure 4:
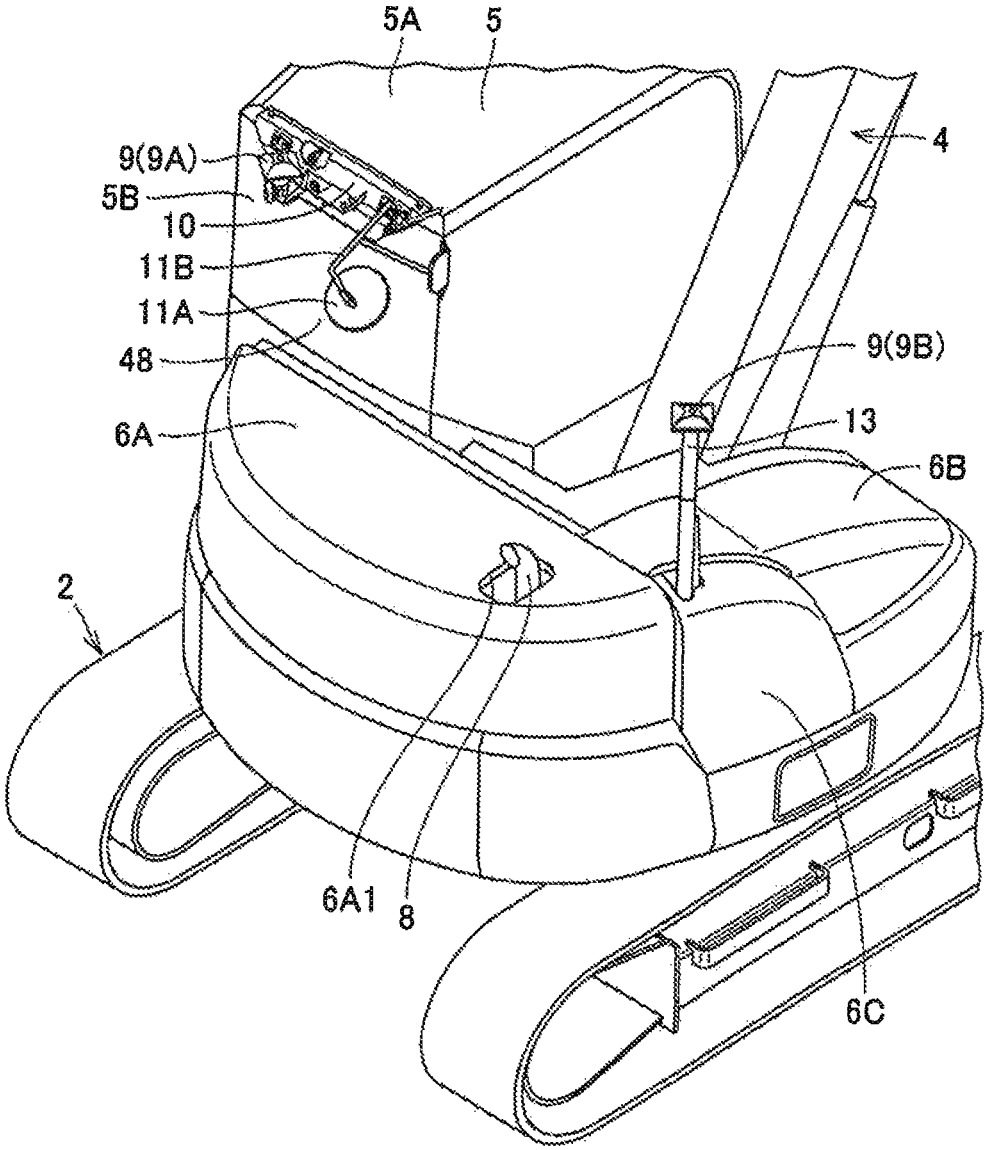
FIG. 4 is a perspective view of the hydraulic excavator shown in FIG. 1 when viewed from the right rear.

FIG. 1 is a side view schematically showing a construction of hydraulic excavator 1 based on an embodiment. FIG. 2 is a plan view of hydraulic excavator 1 shown in FIG. 1. FIG. 3 is a rear view of hydraulic excavator 1 shown in FIG. 1. FIG. 4 is a perspective view of hydraulic excavator 1 shown in FIG. 1 when viewed from the right rear. As shown in FIGS. 1 to 4, hydraulic excavator 1 in the present embodiment mainly has a travel unit 2, a revolving unit 3, and a work implement 4. A vehicular body of hydraulic excavator 1 is constituted of travel unit 2 and revolving unit 3.

Travel unit 2 has a pair of left and right crawler belts 2A. Hydraulic excavator 1 is constructed to be self-propelled as the pair of left and right crawler belts 2A is rotationally driven. Revolving unit 3 is revolvably attached to travel unit 2. Revolving unit 3 mainly has a cab 5, an exterior panel 6, and a counterweight 7.

Cab 5 is arranged on a front left side of revolving unit 3 (a front side of the vehicle). Cab 5 is placed on the vehicular body of hydraulic excavator 1. An operator's compartment is formed inside cab 5. The operator's compartment is a space for an operator to operate hydraulic excavator 1. An operator's seat for an operator to have a seat is arranged in the operator's compartment.

In the present embodiment, positional relation among components will be described with work implement 4 being defined as the reference.

A boom 4A of work implement 4 rotationally moves around a boom pin with respect to revolving unit 3. A trajectory of movement of a specific portion of boom 4A which pivots with respect to revolving unit 3, such as a tip end portion of boom 4A, is in an arc shape, and a plane including the arc is specified. When hydraulic excavator 1 is planarly viewed, the plane is shown as a straight line. A direction in which this straight line extends is a fore/aft direction of the vehicular main body of the work vehicle or a fore/aft direction of revolving unit 3, and it is also simply referred to as the fore/aft direction below. A lateral direction (a direction of vehicle width) of the vehicular main body or a lateral direction of revolving unit 3 is a direction orthogonal to the fore/aft direction in a plan view and also simply referred to as the lateral direction below. The lateral direction refers to a direction of extension of the boom pin. An upward/downward direction of the vehicular main body or an upward/downward direction of revolving unit 3 is a direction orthogonal to the plane defined by the fore/aft direction and the lateral direction and also simply referred to as the upward/downward direction below.

A side in the fore/aft direction where work implement 4 projects from the vehicular main body is defined as the fore direction, and a direction opposite to the fore direction is defined as the aft direction. A right side and a left side in the lateral direction when one faces the fore direction are defined as a right direction and a left direction, respectively. A side in the upward/downward direction where the ground is located is defined as a lower side and a side where the sky is located is defined as an upper side.

The fore/aft direction refers to a fore/aft direction of an operator who sits at the operator's seat in cab 5. The lateral direction refers to a lateral direction of the operator who sits at the operator's seat. The upward/downward direction refers to an upward/downward direction of the operator who sits at the operator's seat. A direction in which the operator sitting at the operator's seat faces is defined as the fore direction and a direction behind the operator sitting at the operator's seat is defined as the aft direction. A right side and a left side at the time when the operator sitting at the operator's seat faces front are defined as the right direction and the left direction, respectively. A foot side of the operator who sits at the operator's seat is defined as a lower side, and a head side is defined as an upper side.

Exterior panel 6 has an engine hood 6A, a soil cover 6B and a sheet metal cover 6C. Engine hood 6A, soil cover 6B and sheet metal cover 6C form a part of an upper surface of revolving unit 3. Engine hood 6A forms the upper surface of revolving unit 3 in the rear of cab 5. Soil cover 6B and sheet metal cover 6C form a part of the upper surface of revolving unit 3 on the right of cab 5. Sheet metal cover 6C forms a rear right corner portion of the upper surface of revolving unit 3 other than engine hood 6A. Soil cover 6B is arranged on the left side and front side of sheet metal cover 6C.

Engine hood 6A and soil cover 6B are formed of a lightweight resin material. An upper surface of hydraulic excavator 1 in the rear of cab 5 is formed of a resin material. Sheet metal cover 6C is formed of a metal material such as a steel material.

A front edge of engine hood 6A extends in the lateral direction. Engine hood 6A is configured to be relatively rotatable with respect to revolving unit 3 with the front edge serving as a pivot point. Engine hood 6A is configured to be openable and closable with respect to the vehicular body of hydraulic excavator 1. When engine hood 6A rotates and moves upward, an engine compartment 14 is opened. When engine hood 6A moves downward, engine compartment 14 is covered with engine hood 6A and becomes unexposed to the outside. Engine hood 6A is configured to be capable of opening and closing engine compartment 14.

Figure 5:
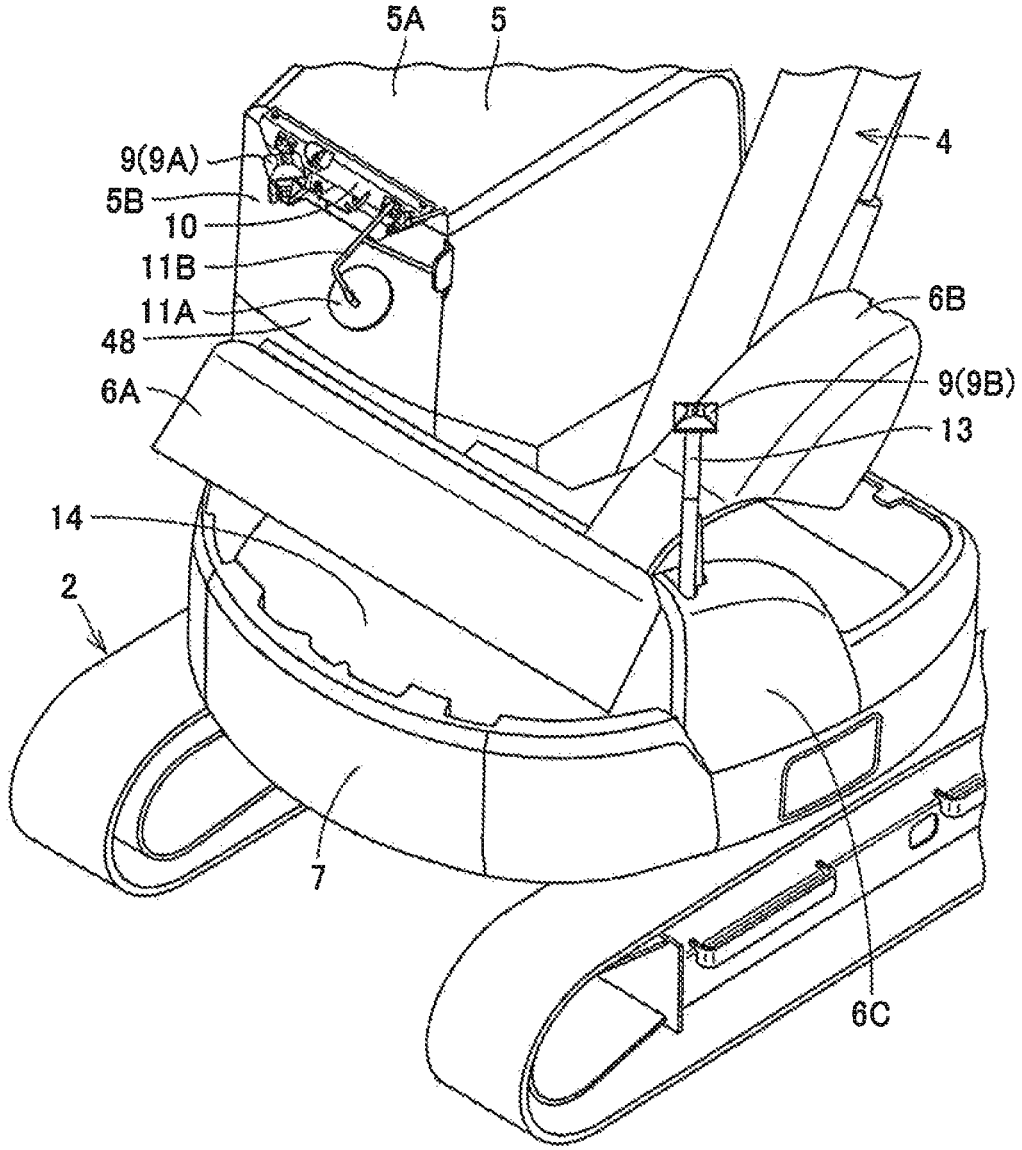
FIG. 5 is a perspective view of a state in which an engine hood and a soil cover are open.

A rear edge of soil cover 6B extends in the lateral direction. Soil cover 6B is configured to be relatively rotatable with respect to revolving unit 3 with the rear edge serving as a pivot point. Soil cover 6B can rotate in parallel with boom 4A of work implement 4. Soil cover 6B covers, from above, an accommodation space that accommodates a fuel tank, a hydraulic oil tank and the like. Soil cover 6B is configured to be capable of opening and closing the accommodation space. FIG. 5 is a perspective view of a state in which engine hood 6A and soil cover 6B are open. When engine hood 6A is opened, engine compartment 14 is exposed. FIG. 5 does not show the components such as, for example, an engine 12 and the fuel tank that are accommodated in the accommodation space covered with soil cover 6B and in engine compartment 14.

Since engine hood 6A and soil cover 6B that are relatively movable with respect to revolving unit 3 are formed of a lightweight resin material, a service person who tries to open and close engine hood 6A and soil cover 6B can manually open and close engine hood 6A and soil cover 6B without the need for a special device. Since engine hood 6A and soil cover 6B are resin mold products and can be easily molded into a desired shape, the design of an outer appearance of hydraulic excavator 1 is improved.

Sheet metal cover 6C covers, from above and the right, an accommodation space that accommodates a main valve and the like. Sheet metal cover 6C is fixed to revolving unit 3. After sheet metal cover 6C is fixed to revolving unit 3 during assembly of hydraulic excavator 1, sheet metal cover 6C is relatively immovable with respect to revolving unit 3.

Soil cover 6B and sheet metal cover 6C are arranged in front of engine hood 6A. Soil cover 6B and sheet metal cover 6C are arranged on the front side of the front edge of engine hood 6A. Since engine hood 6A covers engine 12 from above, soil cover 6B and sheet metal cover 6C are arranged in front of engine 12.

Engine hood 6A and counterweight 7 are arranged on a rear side of revolving unit 3 (a rear side of the vehicle). Engine hood 6A is arranged to cover engine compartment 14 from above and the rear. An engine unit (such as engine 12 and an exhaust gas treatment unit) is accommodated in engine compartment 14. Engine hood 6A is arranged above engine 12. Engine hood 6A is provided with an opening 6A1 formed by cutting a part of engine hood 6A. An exhaust pipe 8 for discharging the exhaust gas of engine 12 into the air projects above engine hood 6A through opening 6A1.

Counterweight 7 is arranged in the rear of the engine compartment for keeping balance of the main body of hydraulic excavator 1 during excavation or the like. Hydraulic excavator 1 is formed as a short tail swing hydraulic excavator having a reduced swing radius of a rear surface. Therefore, a rear surface of counterweight 7 viewed planarly is formed in an arc shape centered at the swing center of revolving unit 3 when viewed from above.

Soil cover 6B and sheet metal cover 6C are arranged on the right of revolving unit 3. Soil cover 6B and sheet metal cover 6C are provided on the right of work implement 4.

Work implement 4 serves for such work as excavation of soil. Work implement 4 is attached on the front side of revolving unit 3. Work implement 4 has, for example, boom 4A, an arm 4B, a bucket 4C, and hydraulic cylinders 4D, 4E, and 4F. Work implement 4 can be driven as boom 4A, arm 4B, and bucket 4C are driven by respective hydraulic cylinders 4F, 4E, and 4D.

A base end portion of boom 4A is coupled to revolving unit 3 with the boom pin being interposed. Boom 4A is attached to revolving unit 3 so as to be rotatable around the boom pin in both directions with respect to revolving unit 3. Boom 4A can be operated in the upward/downward direction. A base end portion of arm 4B is coupled to a tip end portion of boom 4A with an arm pin being interposed. Arm 4B is attached to boom 4A so as to be rotatable around the arm pin in both directions with respect to boom 4A. Bucket 4C is coupled to a tip end portion of arm 4B with a bucket pin being interposed. Bucket 4C is attached to arm 4B so as to be rotatable around the bucket pin in both directions with respect to arm 4B.

Work implement 4 is provided on the right of cab 5. Arrangement of cab 5 and work implement 4 is not limited to the example shown in FIGS. 1 and 2, and for example, work implement 4 may be provided on the left of cab 5 arranged on a front right side of revolving unit 3.

Cab 5 includes a roof portion arranged to cover the operator's seat and a plurality of pillars supporting the roof portion. Each pillar has a lower end coupled to a floor portion of cab 5 and an upper end coupled to the roof portion of cab 5. The plurality of pillars have a front pillar 40 and a rear pillar. Front pillar 40 is arranged in a corner portion of cab 5 in front of the operator's seat. The rear pillar is arranged in a corner portion of cab 5 in the rear of the operator's seat.

Front pillar 40 has a right pillar 41 and a left pillar 42. Right pillar 41 is arranged at the front right corner of cab 5. Left pillar 42 is arranged at the front left corner of cab 5. Work implement 4 is arranged on the right of cab 5. Right pillar 41 is arranged on a side close to work implement 4. Left pillar 42 is arranged on a side distant from work implement 4.

A space surrounded by right pillar 41, left pillar 42, and a pair of rear pillars provides an indoor space in cab 5. The operator's seat is accommodated in the indoor space in cab 5. A door for an operator to enter and exit from cab 5 is provided in a left side surface of cab 5.

A front window 47 is arranged between right pillar 41 and left pillar 42. Front window 47 is arranged in front of the operator's seat. Front window 47 is formed of a transparent material. An operator seated at the operator's seat can visually recognize the outside in front of cab 5 through front window 47. For example, the operator seated at the operator's seat can directly look at bucket 4C excavating soil and existing topography to be executed through front window 47.

Cab 5 has an upper surface 5A forming an outer surface above cab 5, and a rear surface 5B forming an outer surface in the rear of cab 5. Upper surface 5A forms the roof portion of cab 5. A part of rear surface 5B is formed by a rear window 48. Rear window 48 is arranged in the rear of the operator's seat. Rear window 48 is formed of a transparent material. An operator can visually recognize the outside in the rear of cab 5 through rear window 48.

A pair of antennas 9 are attached to revolving unit 3. The pair of antennas 9 are provided on the upper surface of revolving unit 3. Antennas 9 are antennas for GNSS. Antennas 9 are antennas for receiving satellite positioning signals.

The pair of antennas 9 have a main antenna 9A and a sub-antenna 9B. Main antenna 9A and sub-antenna 9B are spaced apart from each other in the lateral direction and arranged on the rear side of revolving unit 3. Of the pair of antennas 9, main antenna 9A is arranged on the left of revolving unit 3 and sub-antenna 9B is arranged on the right of revolving unit 3. Main antenna 9A and sub-antenna 9B are arranged at positions where main antenna 9A and sub-antenna 9B do not protrude from revolving unit 3 when viewed planarly. Main antenna 9A and sub-antenna 9B are arranged within the swing radius of revolving unit 3.

Main antenna 9A is attached to cab 5. Main antenna 9A is attached to cab 5 with a bracket 10 being interposed. Main antenna 9A is attached to a rear portion of cab 5. Main antenna 9A is attached to an upper portion of cab 5.

Main antenna 9A is arranged outside cab 5. Main antenna 9A is not covered with an exterior cover of cab 5. Main antenna 9A is arranged in the rear of rear surface 5B of cab 5. Main antenna 9A is arranged in front of counterweight 7. Main antenna 9A is arranged above engine hood 6A. Main antenna 9A is arranged at a position overlapping with engine hood 6A in a plan view.

Main antenna 9A is not supported by engine hood 6A and soil cover 6B formed of a resin material. Main antenna 9A is not attached to engine hood 6A and soil cover 6B that are openable and closable with respect to the vehicular body of hydraulic excavator 1.

Main antenna 9A is arranged at a height position equal to or lower than that of upper surface 5A of cab 5. Main antenna 9A is arranged below upper surface 5A of cab 5. Main antenna 9A is arranged above an upper end of the operator's seat in cab 5.

When viewed from the rear, main antenna 9A is arranged at a position overlapping with a part of rear window 48. When viewed in the fore/aft direction, main antenna 9A overlaps with a part of a region near an upper edge portion of rear window 48. The upper edge of rear window 48 is arranged at a height position identical to a height position of a part of main antenna 9A.

Main antenna 9A is exposed upward. Main antenna 9A is arranged at a position where rear surface 5B of cab 5 does not obstruct a skyward angular range of view of main antenna 9A. In order to receive a radio wave from a GNSS satellite, main antenna 9A is arranged such that the minimum elevation angle of 15° can be ensured.

Sub-antenna 9B is attached to the vehicular body of hydraulic excavator 1 without cab 5 being interposed. Sub-antenna 9B is provided above sheet metal cover 6C. Sub-antenna 9B overlaps with sheet metal cover 6C in a plan view. Sub-antenna 9B is supported by a mast 13. Mast 13 extends in the upward/downward direction. Mast 13 projects upward from sheet metal cover 6C. Mast 13 penetrates through sheet metal cover 6C. Sub-antenna 9B is fixed to an upper end of mast 13. Sub-antenna 9B is exposed upward, and thus, a skyward angular range of view of sub-antenna 9B is ensured.

Sub-antenna 9B is not supported by engine hood 6A and soil cover 6B formed of a resin material. Sub-antenna 9B is not attached to engine hood 6A and soil cover 6B that are openable and closable with respect to the vehicular body of hydraulic excavator 1.

Sub-antenna 9B is arranged in front of the front edge of engine hood 6A. Since engine hood 6A covers engine 12 from above, sub-antenna 9B is arranged in front of engine 12. A hydraulic pump is directly coupled to engine 12. Engine hood 6A covers, from above, a machine compartment that accommodates the hydraulic pump, and can open and close the machine compartment. Sub-antenna 9B is arranged in front of the machine compartment that accommodates the hydraulic pump.

Sub-antenna 9B is arranged in front of counterweight 7. Sub-antenna 9B is arranged in front of rear surface 5B of cab 5. Sub-antenna 9B is arranged in front of main antenna 9A. In the fore/aft direction, rear surface 5B of cab 5 is interposed between main antenna 9A and sub-antenna 9B. In the fore/aft direction, the front edge of engine hood 6A is interposed between main antenna 9A and sub-antenna 9B. In the fore/aft direction, a rear edge of sheet metal cover 6C is interposed between main antenna 9A and sub-antenna 9B.

Sub-antenna 9B is arranged at a height position lower than that of upper surface 5A of cab 5. Sub-antenna 9B is arranged at a height position lower than that of main antenna 9A.

In the arrangement shown in FIGS. 1 to 4 in which crawler belts 2A of travel unit 2 extend in the fore/aft direction, main antenna 9A overlaps with left crawler belt 2A in a plan view. In the arrangement shown in FIGS. 1 to 4, sub-antenna 9B overlaps with right crawler belt 2A in a plan view.

A mirror 11A is attached to cab 5 with a stay 11B being interposed. Stay 11B is fixed to rear surface 5B of cab 5 and extends rearward from rear surface 5B of cab 5. Mirror 11A is attached to a tip end portion of stay 11B. Mirror 11A is arranged in the rear of cab 5. Mirror 11A is arranged in the rear of the rear surface of cab 5. Mirror 11A is arranged below upper surface 5A that forms the roof portion of cab 5.

Figure 6:
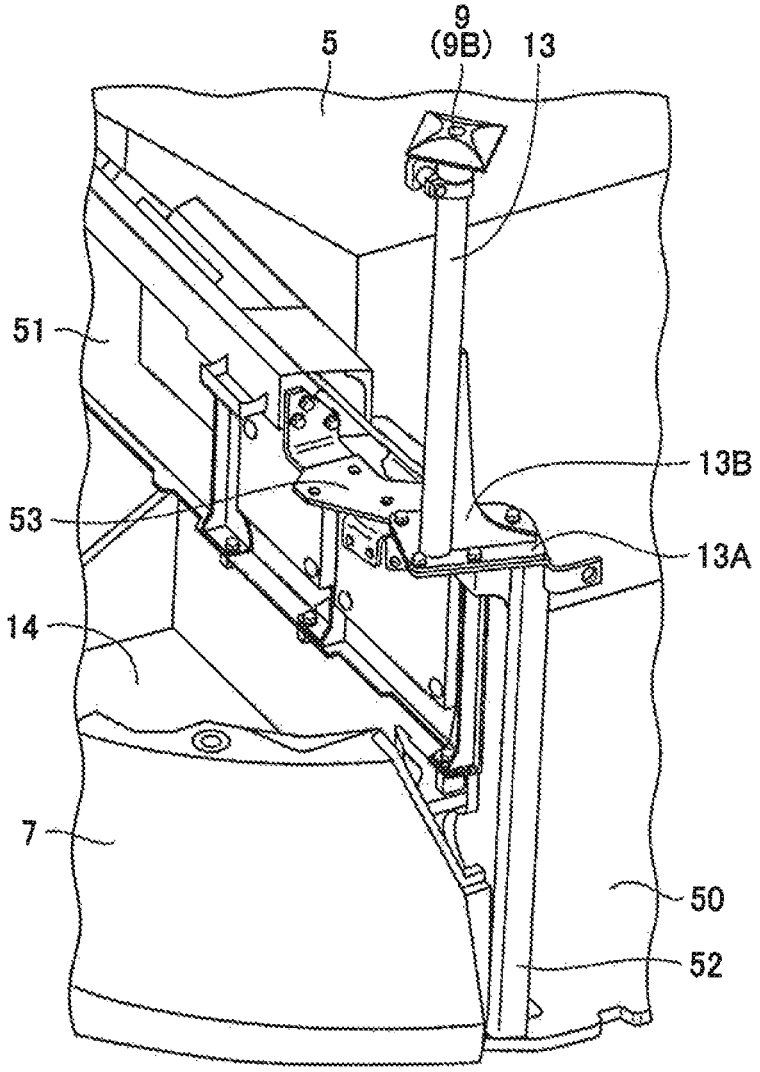
FIG. 6 is an enlarged perspective view showing a support structure of a sub-antenna.

FIG. 6 is an enlarged perspective view showing a support structure of sub-antenna 9B. As shown in FIG. 6, revolving unit 3 has a revolving frame 50. Cab 5 as well as work implement 4, engine 12 and the like that are not shown in FIG. 6 are mounted on revolving frame 50 and arranged on an upper surface of revolving frame 50. FIG. 6 shows only a part of the components mounted on revolving frame 50. Exterior panel 6 including engine hood 6A, soil cover 6B and sheet metal cover 6C is not shown in FIG. 6.

Revolving unit 3 has a partition plate 51. Partition plate 51 has a flat plate-like outline shape extending in the lateral direction and in the upward/downward direction. Partition plate 51 constitutes a front side wall of engine compartment 14. Partition plate 51 serves as a partition between cab 5 and engine compartment 14. Engine compartment 14 is defined by being covered by engine hood 6A, partition plate 51 and counterweight 7 from above and the side.

A post member 52 is provided at a right edge portion of partition plate 51. Post member 52 extends in the upward/downward direction. Post member 52 has a lower end portion fixed to the upper surface of revolving frame 50. Post member 52 supports partition plate 51. Post member 52 is a member that constitutes a support structure for supporting partition plate 51.

A flat plate-like support portion 53 is fixed to an upper end portion of post member 52, Support portion 53 is also fixed to partition plate 51 directly or with another member being interposed. Support portion 53 has an upper surface to which a lower end portion of mast 13 is fixed. Mast 13 has a fixed plate portion 13A at the lower end portion. Fixed plate portion 13A is fixed to support portion 53 using a plurality of bolts. Since mast 13 is planarly fixed to an upper surface of support portion 53, mast 13 is more firmly fixed to support portion 53.

A main body portion of mast 13 extending in the upward/downward direction and fixed plate portion 13A are coupled by a rib portion 13B. Since rib portion 13B is formed, the strength of mast 13 is improved.

Sub-antenna 9B is fixed to a tip end portion (upper end portion) of mast 13. Sub-antenna 9B is fixed to partition plate 51 with mast 13 being interposed. Sub-antenna 9B is fixed to revolving frame 50 with mast 13 and partition plate 51 being interposed. Sub-antenna 9B is fixed to revolving unit 3 without cab 5 being interposed.

Since mast 13 is fixed to revolving unit 3 with high strength and the strength of mast 13 itself is also high, the accuracy of positioning of sub-antenna 9B supported by mast 13 with respect to revolving unit 3 is improved.

Figure 7:
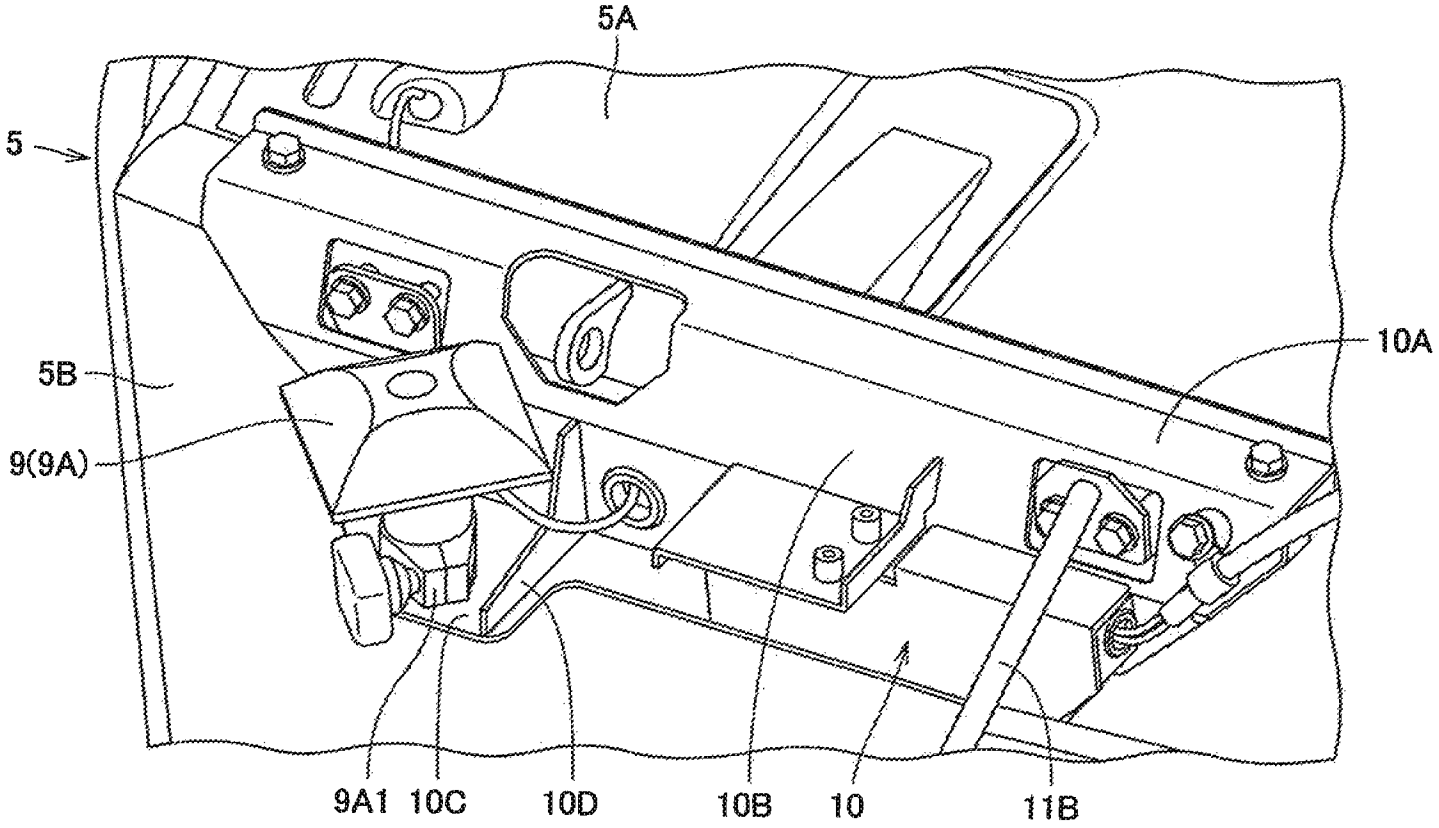
FIG. 7 is an enlarged perspective view showing a support structure of a main antenna.

FIG. 7 is an enlarged perspective view showing a support structure of main antenna 9A. As shown in FIG. 7, bracket 10 has a fixed portion 10A. Fixed portion 10A has a substantially flat plate-like shape and is fixed to upper surface 5A of cab 5 using a plurality of bolts.

Bracket 10 has a fixed portion 10B. Fixed portion 10B has a substantially flat plate-like shape. Fixed portion 10B is continuous to a rear edge of fixed portion 10A. Fixed portion 10B has a shape of being bent with respect to fixed portion 10A. Fixed portion 10B is bent with respect to fixed portion 10A. Fixed portion 10B is bent downward from fixed portion 10A. Since fixed portion 10A is fixed to upper surface 5A of cab 5, fixed portion 10B and a mounting portion 10C described below are bent downward from upper surface 5A of cab 5.

Fixed portion 10B is arranged to face rear surface 5B of cab 5. Fixed portion 10B is fixed to rear surface 5B of cab 5 using a bolt. Since fixed portion 10A is fixed to upper surface 5A of cab 5 and fixed portion 10B is fixed to rear surface 5B of cab 5, bracket 10 is more firmly fixed to cab 5.

A part of fixed portion 10B is cut out to form a through hole. Stay 11B for attaching mirror 11A is arranged to pass through this through hole and is fixed to rear surface 5B of cab 5. A suspending device fixed to rear surface 5B of cab 5 and extending rearward from rear surface 5B is arranged to penetrate through the through hole formed in fixed portion 10B.

Bracket 10 has mounting portion 10C. Mounting portion 10C is continuous to a lower edge of fixed portion 10B. Mounting portion 10C is arranged at a height position lower than that of upper surface 5A of cab 5. Mounting portion 10C has a shape of being bent with respect to fixed portion 10B. Mounting portion 10C is bent with respect to fixed portion 10B. Mounting portion 10C is bent rearward from fixed portion 10B. Since bracket 10 is formed to have a shape obtained by bending a plate member a plurality of times, the strength of bracket 10 is improved.

Fixed portion 10B and mounting portion 10C are coupled by a rib portion 10D. Since rib portion 10D is formed, the strength of bracket 10 is improved.

Main antenna 9A is placed on an upper surface of mounting portion 10C. Main antenna 9A is fixed to mounting portion 10C. Main antenna 9A has a fixed portion 9A1 fixed to mounting portion 10C. Fixed portion 9A1 of main antenna 9A is arranged at a height position lower than that of upper surface 5A of cab 5. Main antenna 9A is attached to cab 5 with bracket 10 being interposed. Fixed portion 9A1 of main antenna 9A is fixed to cab 5 with mounting portion 10C of bracket 10 being interposed. Main antenna 9A is fixed to revolving unit 3 with bracket 10 and cab 5 being interposed.

Since bracket 10 is fixed to cab 5 with high strength and the strength of bracket 10 itself is also high, the accuracy of positioning of main antenna 9A supported by bracket 10 with respect to revolving unit 3 is improved.

Next, the function and effect of the present embodiment will be described.

According to hydraulic excavator 1 based on the embodiment, main antenna 9A is attached to cab 5 and sub-antenna 9B is attached to the vehicular body of hydraulic excavator 1 without cab 5 being interposed, as shown in FIG. 4. Since main antenna 9A and sub-antenna 9B are disposed as described above, main antenna 9A and sub-antenna 9B can be arranged at positions separate from each other in the lateral direction of revolving unit 3. Therefore, the accuracy of measurement of the current position of hydraulic excavator 1 can be improved.

If work implement 4 is present within a reception range of main antenna 9A, work implement 4 blocks a radio signal to be received by main antenna 9A and disallows main antenna 9A to receive a radio wave, or reflects a radio wave to cause a disturbance in a radio signal received by main antenna 9A. Particularly, hydraulic excavator 1 in the embodiment is a short tail swing hydraulic excavator, and thus, work implement 4 raised to the highest position is arranged in the more rear portion of revolving unit 3 in order to reduce the swing radius. As shown in FIG. 4, main antenna 9A is attached to the rear portion of cab 5, and thus, main antenna 9A is arranged on the rear side of revolving unit 3. As a result, blockage of the radio signal to main antenna 9A by work implement 4 can be suppressed. An influence that work implement 4 has on the reception environment of main antenna 9A can be reduced, and thus, a reduction in accuracy of measurement of the current position of hydraulic excavator 1 can be suppressed.

In addition, in order to prevent cab 5 itself from blocking the radio signal to main antenna 9A attached to cab 5, it is necessary to arrange main antenna 9A and cab 5 such that cab 5 is not present within the reception range of main antenna 9A. Therefore, as shown in FIG. 4, main antenna 9A is attached to the upper portion of cab 5, and thus, obstruction of the skyward angular range of view of main antenna 9A by cab 5 can be suppressed. An influence that cab 5 has on the reception environment of main antenna 9A can be reduced, and thus, a reduction in accuracy of measurement of the current position of hydraulic excavator 1 can be suppressed.

In addition, since main antenna 9A is attached to the upper portion of cab 5, blockage of the window, e.g., rear window 48 provided in cab 5 by main antenna 9A is suppressed. Therefore, it is possible to ensure a direct field of view of an operator in the operator's compartment in cab 5 seeing the outside of cab 5.

In addition, as shown in FIGS. 1 and 3, main antenna 9A has fixed portion 9A1 fixed to cab 5 and fixed portion 9A1 is arranged at a height position lower than that of upper surface 5A of cab 5. Therefore, main antenna 9A can be arranged at a position that is relatively lower than that of upper surface 5A of cab 5. As shown in FIGS. 1 and 3, main antenna 9A is arranged at a height position equal to or lower than that of upper surface 5A of cab 5, and thus, it is possible to reliably avoid a situation in which main antenna 9A projects upward from upper surface 5A of cab 5 and exceeds a transport height limit of hydraulic excavator 1.

In addition, as shown in FIGS. 4 and 7, main antenna 9A is attached to cab 5 with bracket 10 being interposed. Bracket 10 has fixed portion 10A fixed to upper surface 5A of cab 5, and fixed portion 10B and mounting portion 10C extending rearward from upper surface 5A of cab 5 and bent downward. Since main antenna 9A is placed on mounting portion 10C located below upper surface 5A of cab 5, main antenna 9A can be more reliably arranged at a height position equal to or lower than that of upper surface 5A of cab 5.

In addition, as shown in FIG. 2, main antenna 9A and sub-antenna 9B are arranged within the swing radius of revolving unit 3. Therefore, contact of main antenna 9A or sub-antenna 9B, or cables connected to these antennas, with a foreign object during swing of revolving unit 3 can be suppressed. Thus, the reliability of hydraulic excavator 1 can be improved.

In addition, as shown in FIG. 2, the upper surface of hydraulic excavator 1 in the rear of cab 5 is formed by engine hood 6A and engine hood 6A is made of a resin material. With such a configuration that main antenna 9A is attached to cab 5 in arranging main antenna 9A in the rear of cab 5, it is not necessary to change the shape of engine hood 6A made of a resin material. Therefore, engine hood 6A can be used in common both in hydraulic excavator 1 in the embodiment including antenna 9 and a hydraulic excavator not including an antenna. Preparation of a new mold to mold engine hood 6A in the embodiment is not required, and thus, the manufacturing cost of hydraulic excavator 1 can be reduced.

In addition, as shown in FIG. 2, sub-antenna 9B is arranged in front of engine 12, and thus, it is not necessary to change the shape of engine hood 6A covering engine 12 from above. Since engine hood 6A can be used in common both in hydraulic excavator 1 in the embodiment including antenna 9 and a hydraulic excavator not including an antenna, the manufacturing cost of hydraulic excavator 1 can be reduced.

In addition, sheet metal cover 6C is formed of a metal material represented by a steel material, and thus, processing is easy. As shown in FIGS. 2 and 4, mast 13 for supporting sub-antenna 9B can be arranged to penetrate through the cut-out part of sheet metal cover 6C. Therefore, with such a configuration that sub-antenna 9B is arranged above sheet metal cover 6C, sub-antenna 9B can be easily attached to revolving unit 3.

In addition, as shown in FIGS. 4 and 5, engine hood 6A is openable and closable with respect to revolving unit 3. When antenna 9 is fixed to a structure that relatively moves with respect to revolving unit 3, antenna 9 moves along with the movement of the structure, and thus, calibration is frequently required, which is troublesome. Main antenna 9A in the embodiment is attached to cab 5, sub-antenna 9B in the embodiment is arranged in front of engine compartment 14, and main antenna 9A and sub-antenna 9B are not attached to engine hood 6A. Therefore, even when engine hood 6A is moved to open and close engine compartment 14, main antenna 9A and sub-antenna 9B do not move, and thus, recalibration is not required. Thus, an increase in frequency of calibration of antenna 9 can be avoided and a service person's burden associated with maintenance work can be reduced.

In the above-described embodiment, description has been given of the example in which bracket 10 has fixed portion 10A fixed to upper surface 5A of cab 5 and fixed portion 10B fixed to rear surface 5B of cab 5. Bracket 10 may be configured to be fixed only to rear surface 5B of cab 5 and extend rearward from rear surface 5B of cab 5. Main antenna 9A is not limited to the configuration in which main antenna 9A is fixed to cab 5 with bracket 10 being interposed, and main antenna 9A may be directly fixed to cab 5.

In the above-described embodiment, description has been given of the example in which main antenna 9A as a whole is arranged at a height position equal to or lower than that of upper surface 5A of cab 5. When a structure that is not removed even during transport of hydraulic excavator 1 is mounted on upper surface 5A of cab 5, the transport height limit of hydraulic excavator 1 is defined by an upper end portion of the structure. In this case, main antenna 9A does not exceed the transport height limit as long as main antenna 9A is arranged at a height position equal to or lower than that of the upper end portion of the structure. Therefore, a part of main antenna 9A may be arranged at a position higher than that of upper surface 5A of cab 5.

It should be understood that the embodiment disclosed herein is illustrative and non-restrictive in every respect. The scope of the present invention is defined by the terms of the claims, rather than the description above, and is intended to include any modifications within the scope and meaning equivalent to the terms of the claims.

REFERENCE SIGNS LIST

1 hydraulic excavator; 2 travel unit; 2A crawler belt; 3 revolving unit; 4 work implement; 4A boom; 4B arm; 4C bucket; 4D, 4E, 4F hydraulic cylinder; 5 cab; 5A upper surface; 5B rear surface; 6 exterior panel; 6A engine hood;

6A1 opening; 6B soil cover; 6C sheet metal cover; 7 counterweight; 8 exhaust pipe; 9 antenna; 9A main antenna; 9A1 fixed portion; 9B sub-antenna; 10 bracket; 10A, 10B fixed portion; 10C mounting portion; 10D, 13B rib portion; 11A mirror; 11B stay; 12 engine; 13 mast; 13A fixed plate portion; 14 engine compartment; 40 front pillar; 41 right pillar; 42 left pillar; 47 front window; 48 rear window; 50 revolving frame; 51 partition plate; 52 post member; 53 support portion.

The invention claimed is:

1. A hydraulic excavator comprising:

a vehicular body including a travel unit and a revolving unit revolvably attached to the travel unit;

a cab placed on a front left side of the revolving unit; and a pair of first and second antennas for receiving satellite positioning signals, the first antenna being attached to a rear portion of the cab and arranged in the rear of a rear surface of the cab, the second antenna being provided above an upper surface of the revolving unit on the right of the cab and arranged in front of the rear surface of the cab.

2. The hydraulic excavator according to claim 1, wherein the first antenna is attached to an upper portion of the cab.

3. The hydraulic excavator according to claim 2, wherein the first antenna includes a fixed portion fixed to the cab, and the fixed portion is arranged at a height position lower than that of an upper surface of the cab.

4. The hydraulic excavator according to claim 2, wherein the first antenna is arranged at a height position equal to or lower than that of an upper surface of the cab.

5. The hydraulic excavator according to claim 2, further comprising a bracket fixed to an upper surface of the cab and bent downward from the upper surface of the cab, wherein the first antenna is attached to the cab with the bracket being interposed.

6. The hydraulic excavator according to claim 1, wherein the hydraulic excavator is a short tail swing hydraulic excavator, the first antenna and the second antenna are arranged within a swing radius of the revolving unit, and a rear surface of a counterweight is formed in an arc shape centered at a swing center of the revolving unit.

7. The hydraulic excavator according to claim 1, wherein an upper surface of the hydraulic excavator in the rear of the cab is made of a resin material.

8. The hydraulic excavator according to claim 1, further comprising an engine, wherein the second antenna is arranged in front of the engine.

9. The hydraulic excavator according to claim 8, further comprising a sheet metal cover arranged in front of the engine and fixed so as to be immovable with respect to the vehicular body, wherein the second antenna is arranged above the sheet metal cover.

10. The hydraulic excavator according to claim 8, further comprising an engine hood arranged above the engine, wherein the engine hood is openable and closable with respect to the vehicular body.

11. The hydraulic excavator according to claim 1, wherein the hydraulic excavator is a short tail swing hydraulic excavator, and a rear surface of a counterweight is formed in an arc shape centered at a swing center of the revolving unit when viewed from above.

12. The hydraulic excavator according to claim 1, wherein the second antenna is fixed to an upper end of a mast extending in the upward/downward direction.

13. The hydraulic excavator according to claim 1, further comprising:

an engine arranged on the revolving unit;

a sheet metal cover arranged in front of the engine and fixed so as to be immovable with respect to the revolving unit;

and the second antenna being supported by a mast, the mast extending in an upward/downward direction, the mast penetrating through the sheet metal cover, and the second antenna being arranged above the sheet metal cover.

* * * * *